United States Patent [19]

Watzke et al.

[11] Patent Number: 4,665,337

[45] Date of Patent: May 12, 1987

[54] GAS DISCHARGE ARRESTER AND METHOD OF MANUFACTURE

[75] Inventors: Franz Watzke, Diessen; Gerhard Lange; Juergen Boy, both of Berlin, all of Fed. Rep. of Germany

[73] Assignee: Siemens Aktiengesellschaft, Berlin and Munich, Fed. Rep. of Germany

[21] Appl. No.: 651,958

[22] Filed: Sep. 19, 1984

[30] Foreign Application Priority Data

Sep. 30, 1983 [DE] Fed. Rep. of Germany ..... 3335602

[51] Int. Cl.[4] ..... H01J 17/00

[52] U.S. Cl. ..... 313/231.11; 361/120; 313/346 R

[58] Field of Search ..... 361/120; 313/231.11, 313/346, 225

[56] References Cited

U.S. PATENT DOCUMENTS 3,266,861 8/1966 Bleukens et al. ..... 316/16
4,123,682 10/1978 Lange et al. ..... 361/120
4,287,548 9/1981 Hahndorff ..... 313/231.11
4,303,846 12/1981 Kimura et al. ..... 313/558

FOREIGN PATENT DOCUMENTS 1270698 6/1968 Fed. Rep. of Germany .
2619866 11/1977 Fed. Rep. of Germany .
2060991 5/1981 United Kingdom ..... 313/346 R

*Primary Examiner*—Stewart J. Levy
*Assistant Examiner*—Hezron E. Williams
*Attorney, Agent, or Firm*—Hill, Van Santen, Steadman & Simpson

[57] ABSTRACT

For the reduction of the work function of the electrodes, gas discharge arresters contain an activator which contains, for example, an alkali metal or nickel. Getter materials, for example barium aluminum, serve the purpose of gettering of gases which can arise in the surge voltage arrester during manufacture or during operation. With these substances, the spreads of the minium operating voltage can be maintained small as long as the activator is only moderately heated. For high loads, the activator contains an alkali metal or nickel and, in addition, barium aluminum, whereby tungsten and/or molybdenum is present as the additional substance. An activator of this type guarantees constant values of the minumum operating voltage and a narrow spread of these values even after a high electrical and thermal load. A frequent switching of the maximally permissible current is possible without an interfering alteration of the electrical characteristics.

10 Claims, No Drawings

GAS DISCHARGE ARRESTER AND METHOD OF MANUFACTURE

BACKGROUND OF THE INVENTION

1. Field of the Invention

The present invention relates to a gas discharge arrester in which two or more electrodes are oppositely disposed, whereby at least one of the electrodes is coated with an activator which contains at least one alkali metal and one barium aluminum alloy.

2. Description of the Prior Art

Arresters of the type generally set forth above are known from the German published application 26 19 866. According to this German application, the activator compound which is introduced in the gas discharge arrester contains barium aluminum, an alkali halide, and titanium. Through the addition of titanium, the minimum threshold voltage is to be kept stable and a long life is to be attained.

SUMMARY OF THE INVENTION

By contrast, the object of the present invention is to reduce the spread between units and the collective spread of the electric values of the gas discharge arrester and increase the thermal and electrical loading capacity of the arrester without necessitating the tolerance of an alteration of its electrical characteristic values.

The above object is achieved in a gas discharge arrester of the type set forth above which is characterized in that the activator additionally contains metallic tungsten and/or molybdenum or that the activator additionally contains metallic nickel and metallic tungsten and/or molybdenum. The addition of tungsten and/or molybdenum, instead of titanium, results in a considerable improvement of the current-carrying capacity of the arrester. This is apparently due to the fact that tungsten and molybdenum become active as getter materials to a notable extent only above 1000° C. and that, even in the case of yet considerably higher temperatures, the gases, once accumulated, are no longer released. In the case of current loads which are substantially higher than those permissible in the state of the art, additionally a great many switching operations can thereby be carried out without the minimum operating voltage being altered. Accordingly, the arrester is particularly well suited for switching applications and as a surge voltage arrester having a long life.

In the case of the composition of the invention, virtually a two-stage gettering exists. Gases which are formed at low temperatures below approximately 900° C. are gettered by the barium aluminum; if, however, the temperature of the activation compound briefly rises above 1000° C., the latter materials are again released by the barium aluminum and taken over by the tungsten or molybdenum.

Tungsten is therefore particularly suited for very high peak currents and a related very strong heating of the activator, whereas, in the case of moderate overheating, molybdenum is advantageous and, in addition, more favorable with respect to cost.

In an activation compound utilizing nickel, particularly the addition of tungsten has the special advantage that a particularly low cathode sputtering occurs, that therefore particularly little material evaporates from the electrodes. Evaporating material leads to metal layers on the housing which, in turn, again enlarges the capacitance of the surge voltage arrester. Capacitance enlargement must be avoided for many applications, particularly for high-frequency applications. For this purpose, the utilization of molybdenum is sufficient, insofar as extreme requirements do not render the use of tungsten necessary.

A further particular advantage of the composition of the activator, according to the invention, is an increased tendency towards the formation of sintered metal. Particularly in the case of the utilization of nickel, layers of considerably increased bonding strength than without the addition of molybdenum or tungsten result. For this purpose, it is advantageous if the activator contains equal proportions by weight of nickel and molybdenum.

Insofar as a sufficient bonding strength is guaranteed, the proportion of molybdenum is advantageously adjusted to the required quantity of barium aluminum, whereby the proportion by weight of barium aluminum to that of molybdenum advantageously is approximately 1:3. The bonding strength suffices in the case of the presence of alkali metal as a rule, and it suffices in the case of utilization of nickel in instances of low mechanical stress.

DESCRIPTION OF THE PREFERRED EMBODIMENTS

Surge voltage arresters constructed in accordance with the present invention are advantageously manufactured by a method wherein an activator compound is applied on at least one electrode, which activator compound contains the necessary starting substances in powder form, in that the arrester is sealed in a gas-tight fashion and subsequently subjected to a temperature treatment and an electrical formation by current pulses and the current pulses are so dimensioned that the temperature in the activator is briefly raised above 1000° C. Through this method, first all volatile substances are gettered by the barium aluminum; however, with the increase of the temperature they are again released and bound in a stable form by the tungsten, or by the molybdenum, respectively. Accordingly, also in the case of high loads, they can no longer lead to interferences in operation.

In the case of this method, the initial substances are advantageously blended in the form of powder with a grain size of between 0.2, μm and 50 μm, mixed with a chemically-inactive liquid to form a paste and thus applied on the electrode. Alcohol, for example, is suitable as the chemically-inactive liquid.

EXAMPLE I

For the described method, advantageously, an activator compound with the following composition is employed:

25% by weight to 90% by weight alkali halide;
3% by weight to 50% by weight barium aluminum; and
5% by weight to 20% by weight molybdenum.

EXAMPLE II

Particularly favorable values are obtained pursuant to utilization of an activator compound with the following composition:

60% by weight potassium chloride;
10% by weight barium aluminum; and
30% by weight molybdenum.

In the described tempering process, potassium is released from these compounds, potassium reducing the work function of the electrodes, whereby the halide is bound by the getter metals. The potassium resulting in the liquid state, however, binds the activator. Upon cooling, a sufficiently secure bonding results.

Whereas the embodiment containing patassium, even in the case of cathode sputtering, yields no electrically-conductive deposits on the housing wall, in the described example with equal proportions by way of nickel and molybdenum, the cathode sputtering is already so far reduced that this composition can also be employed for arresters having ignition strips on the interior side of the insulator, without the ignition strips vaporizing, and hence without the minumum operating transient voltage increasing to an impermissible extent.

In the embodiment pursuant to utilization of nickel powder, the barium aluminum alloy acts as an emission-determining substance. The nickel component forms a heat-dissipating sinter-skeleton and, together with the molybdenum, forms a firmly-adhering layer on the electrode. The molybdenum powder component, in turn, forms the described getter for non-inert gas components.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

We claim:

1. In a gas discharge arrester of the type in which at least two electrodes are oppositely disposed and in which at least one of the electrodes is coated with an activator comprising at least one alkali metal and one barium-aluminum alloy, the improvement therein of:

the activator additionally comprising metallic tungsten.

2. In a gas discharge arrester of the type in which at least two electrodes are oppositely disposed and in which at least one of the electrodes is coated with an activator comprising at least one alkali metal and one barium-aluminum alloy, the improvement therein of:

the activator additionally comprising molybdenum.

3. The improved gas discharge arrester of claim 2, and further defined as:

a proportion by weight of the barium-aluminum alloy to the molybdenum of 1:3.

4. In a gas discharge arrester of the type in which at least two electrodes are oppositely disposed and in which at least one of the electrodes is coated with an activator comprising at least one alkali metal and one barium-aluminum alloy, the improvement therein of:

the activator additionally comprising metallic tungsten and metallic molybdenum.

5. The improved gas discharge arrester of claim 4, and further defined as:

a proportion by weight of the barium-aluminum alloy to the molybdenum of 1:3.

6. In a gas discharge arrester of the type in which at least two electrodes are oppositely disposed and in which at least one of the electrodes is coated with an activator comprising a barium-aluminum alloy, the improvement therein of:

the activator additionally comprising metallic tungsten and metallic nickel.

7. In a gas discharge arrester of the type in which at least two electrodes are oppositely disposed and in which at least one of the electrodes is coated with an activator comprising a barium-aluminum alloy, the improvement therein of:

the activator additionally comprising metallic nickel, metallic tungsten and metallic molybdenum.

8. The improved gas discharge arrester of claim 7, and further defined as:

equal proportions by way of nickel and molybdenum.

9. In a gas discharge arrester of the type in which at least two electrodes are oppositely disposed and in which at least one of the electrodes is coated with an activator comprising a barium-aluminum alloy, the improvement therein of:

the activator additionally comprising metallic nickel and metallic molybdenum.

10. The improved gas discharge arrester of claim 9, and further defined as:

equal proportions by weight of nickel and molybdenum.

* * * * *